United States Patent [19]

Vasiljevic

[11] 3,983,955

[45] Oct. 5, 1976

[54] ARRANGEMENT FOR DAMPING SOUND WITH RESONATORS

[76] Inventor: Costa Silard Vasiljevic, Hausserstr. 114, 7400 Tubingen, Germany

[22] Filed: Mar. 20, 1974

[21] Appl. No.: 452,810

[30] Foreign Application Priority Data

Mar. 22, 1973 Germany ..... 2314396

[52] U.S. Cl. ..... 181/33 G; 52/144; 52/309

[51] Int. Cl.[2] ..... E04B 1/74; E04B 1/99

[58] Field of Search ..... 181/33 G, 33 GD, 48, 181/33 R, 33 HA, 33 HB, 50; 52/144, 145

[56] References Cited

UNITED STATES PATENTS

| | | | |
|---|---|---|---|
| 2,007,130 | 7/1935 | Munroe | 52/144 |
| 2,271,892 | 2/1942 | Bourne | 181/48 |
| 2,959,243 | 11/1960 | Smith | 181/48 |
| 3,087,574 | 4/1963 | Watters | 181/33 G |
| 3,353,626 | 11/1967 | Cremer | 181/48 |
| 3,517,468 | 6/1970 | Woods | 52/144 |

FOREIGN PATENTS OR APPLICATIONS

| | | | |
|---|---|---|---|
| 221,410 | 5/1959 | Australia | 181/33 G |
| 1,085,605 | 7/1954 | France | 52/144 |
| 1,117,463 | 2/1956 | France | 181/33 G |
| 657,966 | 11/1963 | Italy | 52/145 |
| 827,042 | 2/1960 | United Kingdom | 52/145 |
| 786,377 | 11/1957 | United Kingdom | 52/145 |

*Primary Examiner*—John E. Murtagh

[57] ABSTRACT

An arrangement for silencing or damping sound by resonators having space elements with closed air chambers. The resonators have openings in the outside wall facing the air stream, and air in the chambers constitutes a spring. The air in the openings constitutes an element of mass. The combination is caused to oscillate by the sonic energy of the flowing air, thus forming a vibrating system which absorbs the sonic energy.

6 Claims, 11 Drawing Figures

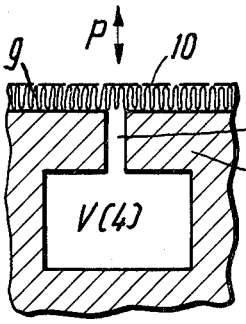
Fig.1
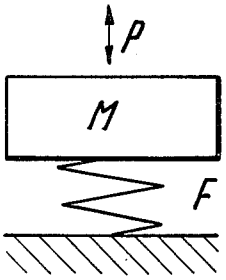
Fig.2
Fig.3
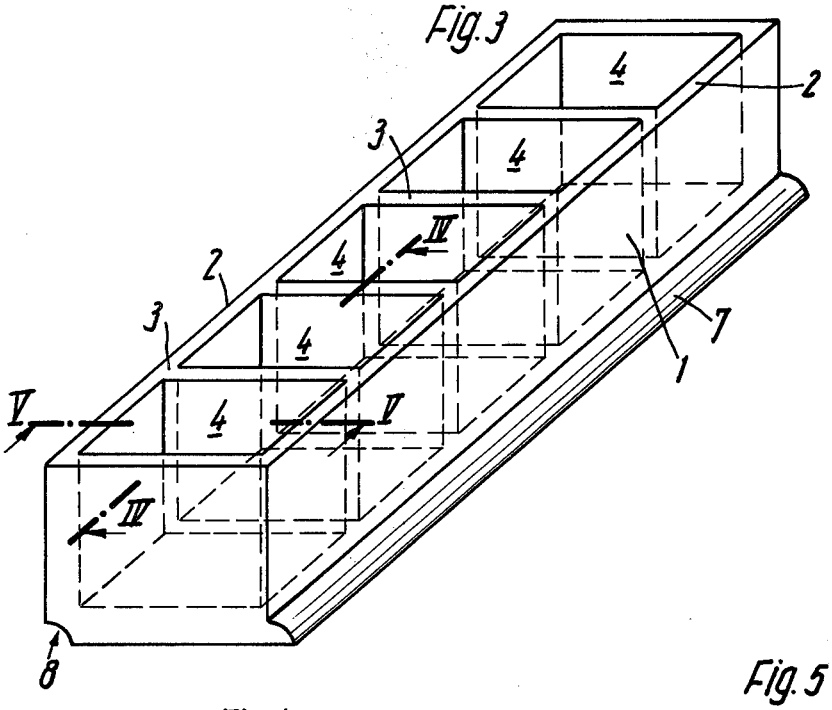
Fig.4
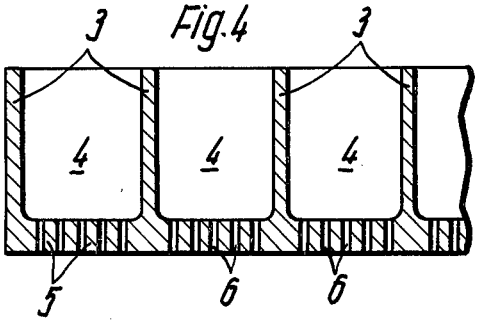
Fig.5
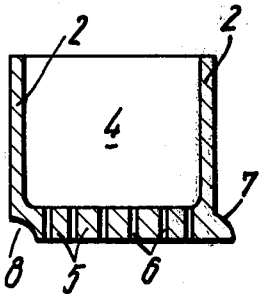

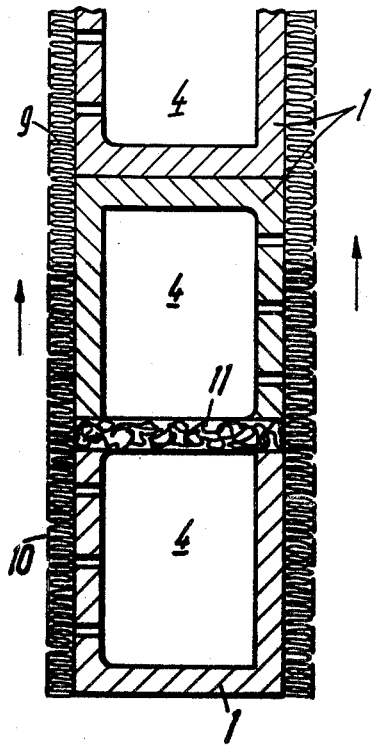
Fig. 9
Fig. 10
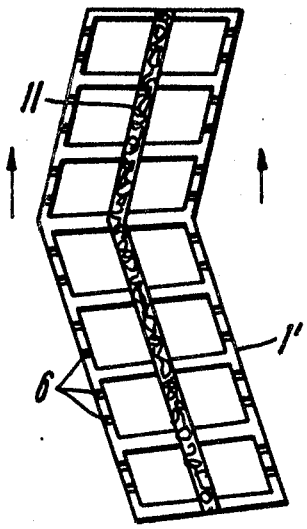
Fig. 11
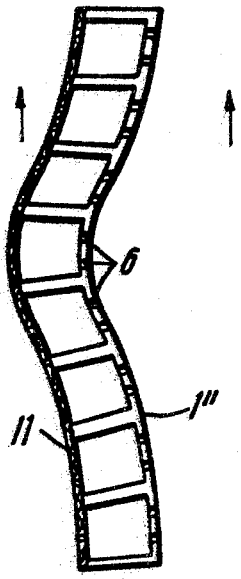

ARRANGEMENT FOR DAMPING SOUND WITH RESONATORS

BACKGROUND OF THE INVENTION

The present invention concerns a device for damping sound, which may be applied as a tubular damper, as an area damper, or the like. From Patent DBP No. 1,196,877, building blocks for the constuction of damping devices are known, which work according to the resonator principle. The resonators, there, are formed from space elements with closed air chambers, exhibiting openings in the outside wall facing the air stream, where the air in the chambers constitutes a spring. The air in the openings constitutes elements of mass. The combination is caused to oscillate by the sonic energy, and constitutes a vibrating system absorbing the sonic energy. There the hollow space formed in such a resonator is closed to the surroundings in a rigid and airtight manner on all sides.

In area dampers composed of resonators, there is normally found a rigid, totally reflecting wall between neighboring hollow spaces, which acoustically separates the two neighboring resonators completely. Accordingly, it is an object of the present invention to improve the damping performance of the previously-known resonator-dampers.

Another object of the present invention is to provide an arrangement of the foregoing character which is simple in design and may be economically fabricated.

A still further object of the present invention is to provide an arrangement, as described, which is reliable in operation and may be readily maintained.

SUMMARY OF THE INVENTION

The objects of the present invention are achieved by providing an arrangement in which at least two resonators are coupled to each other by the insertion of a non-rigid separation layer.

Preferably, the separation layer can here exhibit primarily the characteristics of a spring or mass. Usefully, the layer consists of a soft material, e.g., felt, mineral fiber felt, soft foam, elastic foam material, or the like.

Dependent on the construction of the device, the resonators can be arranged so that the spaces constituting the springs face each other, where the non-rigid separation layer is placed between the two. In another arrangement, the resonators have the wall containing the openings facing to one side, and arranged behind each other, with the non-rigid separation layer inserted in between.

Resonators, the spring-forming space of which is open to the side, can also be used, where several double resonators with their open sides facing each other are arranged next to each other with insertion of the non-rigid separation layer.

A multitude of resonators can, furthermore, be formed into area or strip arrays, and these can run in a manner in which they are domed, bent, or curved in the direction of the air flow. On the other hand, the resonators can be covered on the outer wall having the openings, by a damping material such as sillan, silicone, rock wool, or the like.

The advantages of the device in accordance with the present invention lie in substantial increase in silencing, where the original resonant frequency as well as the half-power bandwidth of the resonance curve are practically unchanged. The soft separation layer coupling the resonators constitutes a previously-unknown additional parameter for tuning the resonant frequency, where the separation layer can be spatially arranged as desired, in relation to the resonator bottom containing the openings.

The advantages of the present invention are summarized as follows:

1. Increase in the specific attenuation;
2. An additional parameter, previously unknown for tuning the resonant frequency through adaptable dimensioning of the coupling separation layer;
3. The coupling separation layer also permits subsequent tuning adaptations through changes of or on the separation layer;
4. Reduced working and material costs, since the coupling separation layer is generally loosely inserted;
5. Elimination of tolerance and hence waste problems, since the coupling separation layers, regardless of the desired acoustic characteristics, always consist of sufficiently soft materials.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIGS. 1 and 2 are schematic diagrams for the explanation of the principle of the resonator, in accordance with the present invention;

FIG. 3 is a perspective view of a building block consisting of resonators;

FIG. 4 is a cross-section view taken along lines IV — IV in FIG. 3;

FIG. 5 is a cross-section view taken along lines V — V in FIG. 3;

FIGS. 6 through 9 are cross-sectional views of various arrangements of resonators according to the invention; and FIGS. 10 – 11 are schematic views of different embodiments of resonator building blocks for silencers or sound dampers.

DESCRIPTION OF THE PREFERRED EMBODIMENTS

Figure 6:
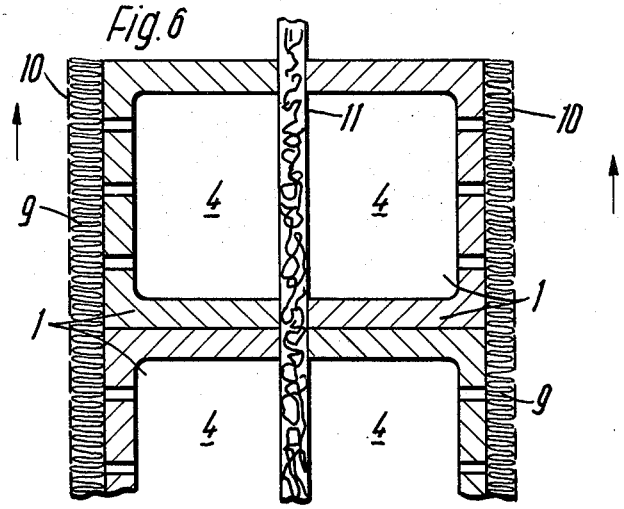

Referring to the drawing, the construction and mode of operation of the resonators in accordance with the present invention are shown in FIGS. 1 and 2. In FIG. 1, the resonator consists of a preferably tubular throat with hollow space V behind it, which can be attuned to each other for given frequencies. The mode of operation is analogous to the mechanical vibrating system shown in FIG. 2, and may be described as follows: The air in the throat acts, on excitement by a periodic alternating force P — in this case, sonic air oscillations — as a mass with inertia M, while the air enclosed in space V acts like the spring F. Such a resonator, just like the vibrating system shown in FIG. 2, has a definite frequency of resonance, at which the sound absorption can reach as close as desired to 100 %. Through tuning by the appropriate choice of parameters, practically any resonant frequency can be achieved. For practical applications, a broad resonance curve is required. This is obtained by lining one of the two resonator throat openings with a porous material of appropriate acoustic resistance.

The individual resonators are preferably combined to form building blocks, out of which dampers or silencers of any desired type can be composed. FIGS. 3 through 5 show an embodiment of such building blocks, where the resonators can be combined into arrays behind each other, next to each other, or in area like formations. Usefully, resonator inserts 1 made of foam material, e.g., styropor, are applied. Essentially they have the form of boxes, where the walls along the length 2 and the cross walls 3 form the chambers 4. The bottom 5 is made somewhat thicker. The bottom is provided with openings 6 arranged next to and behind each other, for forming the above-mentioned tubular throats for the abutting spaces V (chambers 4). The combination of resonator inserts 1 into tubular or area-like formations is formed by the provision of a protrusion 7 on one side and an extrusion 8 on the opposite side.

Usually the openings 6 are covered by a porous material 9 of appropriate acoustic resistance, for example glass wool, sillan, silicone, or such similar materials. This, in turn, is held by a grid or grille 10.

According to the invention, two resonator inserts 1 are always coupled together. The air chambers 4 facing each other are separated from each other only by a soft separation layer 11 of felt or other soft material.

Figure 7:
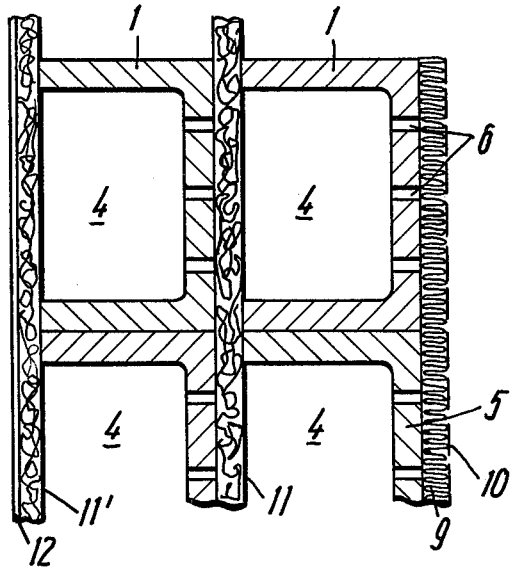

In the arrangement of FIG. 7, the resonator inserts 1 are positioned behind each other, so that their bottoms 5 carrying the openings 6 point in one direction, and the soft separation layers are inserted between them. The resonators 1 facing the outside can, if desired, be provided with a further separation layer 11' with a stiff cover 12.

Figure 8:
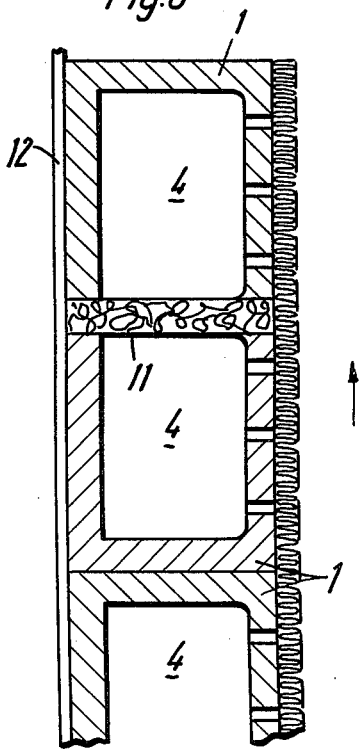

FIGS. 8 and 9 show additional possibilities of arrangements of resonator inserts, where the chambers 4 are open to the side, and the separation layer 11 is inserted between neighboring resonators.

FIGS. 10 and 11 show other forms of embodiments of resonator inserts 1' and 1'', which are folded, bent, or domed in the direction of the air flow. The air chambers are covered by a hard covering layer or by a soft separation layer according to the present invention. If required, adjacent arrangements, next to each other, or arrangements behind each other of the individual resonators, described above, can be applied and combined.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. An arrangement for damping sound comprising, in combination, at least two air chambers each having side walls and a base portion on one end of said side walls, the other ends of said side walls facing each other; a flexible separation layer between said two air chambers, said flexible separation layer being inserted between said other ends of said side walls, said base portion having a plurality of adjacently located openings facing a stream of air passing into said air chambers, said chambers comprising resonators, the air in said chambers comprising spring means and the air in said openings comprising mass means oscillating by the sonic energy in said stream of air, the combination of said mass means and said spring means forming a vibrating system for absorbing sonic energy, the air in one of said chambers influencing the air in the other one of said chambers through said flexible separation layer, said stream of air having two branches, one branch flowing past one base portion of said two air chambers, and the other branch flowing past the base portion of the other one of said two air chambers, said resonators being comprised of plastic foam material.

2. The arrangement as defined in claim 1 wherein said separation layer comprises part of said vibrating system.

3. The arrangement as defined in claim 1 wherein said resonators form building blocks with said separation layer therebetween.

4. The arrangement as defined in claim 1 wherein said separation layer comprises substantially soft material.

5. The arrangement as defined in claim 1 wherein said resonators are covered with sound damping material.

6. An arrangement for damping sound comprising, in combination, at least two air chambers each having side walls and a base portion on one end of said side walls, the other ends of said side walls facing each other; a flexible separation layer between said two air chambers, said flexible separation layer being inserted between said other ends of said side walls, said base portion having a plurality of adjacently located openings facing a stream of air passing into said air chambers, said chambers comprising resonators, the air in said chambers comprising spring means and the air in said openings comprising mass means oscillating by the sonic energy in said stream of air, the combination of said mass means and said spring means forming a vibrating system for absorbing sonic energy, the air in one of said chambers influencing the air in the other one of said chambers through said flexible separation layer, said stream of air having two branches, one branch flowing past one base portion of said two air chambers, and the other branch flowing past the base portion of the other one of said two air chambers, said separation layer comprising part of said vibrating system and being of substantially soft material, said resonators forming building blocks with said separation layer therebetween, said resonators being comprised of plastic foam material; and sound damping material covering said resonators on said wall with said openings.

* * * * *